US008061898B2

(12) United States Patent
Pawloski et al.

(10) Patent No.: US 8,061,898 B2
(45) Date of Patent: Nov. 22, 2011

(54) VENTING CLOSURE MECHANISM

(75) Inventors: James C. Pawloski, Bay City, MI (US); Brian C. Dais, Saginaw, MI (US); John O. McCree, Bay City, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 380 days.

(21) Appl. No.: 12/501,756

(22) Filed: Jul. 13, 2009

(65) Prior Publication Data

US 2010/0014786 A1 Jan. 21, 2010

Related U.S. Application Data

(60) Provisional application No. 61/080,893, filed on Jul. 15, 2008.

(51) Int. Cl.

| | |
|---|---|
| ***B65D 33/16*** | (2006.01) |
| ***B65D 33/01*** | (2006.01) |
| ***B65D 33/00*** | (2006.01) |
| ***A44B 1/04*** | (2006.01) |
| ***A44B 19/00*** | (2006.01) |

(52) U.S. Cl. ..... 383/59; 383/61.2; 383/63; 383/103; 383/105; 24/399; 24/400; 24/585.12

(58) Field of Classification Search ..... 383/59, 383/63, 61.2, 103, 100, 105; 24/399, 400, 24/585.12

See application file for complete search history.

(56) References Cited

U.S. PATENT DOCUMENTS

| | | | | |
|---|---|---|---|---|
| 5,017,021 | A | 5/1991 | Simonsen et al. | |
| 5,140,727 | A | 8/1992 | Dais et al. | |
| RE34,554 | E | 3/1994 | Ausnit | |
| 5,403,094 | A | 4/1995 | Tomic | |
| 5,509,734 | A * | 4/1996 | Ausnit | 383/63 |
| 5,540,500 | A | 7/1996 | Tanaka | |
| 5,911,508 | A | 6/1999 | Dobreski | |
| 6,010,244 | A | 1/2000 | Dobreski et al. | |
| 6,167,597 | B1 * | 1/2001 | Malin | 24/585.1 |
| 6,185,796 | B1 * | 2/2001 | Ausnit | 24/585.1 |
| 6,299,343 | B1 | 10/2001 | Pekerman | |
| 6,691,383 | B2 | 2/2004 | Linton | |
| 6,692,147 | B2 | 2/2004 | Nelson | |
| 6,854,886 | B2 * | 2/2005 | Piechocki et al. | 383/59 |
| 6,955,465 | B2 | 10/2005 | Machacek et al. | |
| 7,004,632 | B2 | 2/2006 | Hamilton et al. | |
| 7,036,988 | B2 | 5/2006 | Olechowski | |
| 7,140,772 | B2 | 11/2006 | Bois et al. | |
| 7,241,046 | B2 * | 7/2007 | Piechocki et al. | 383/59 |
| 7,260,871 | B2 | 8/2007 | Borchardt et al. | |
| 7,270,479 | B2 | 9/2007 | Nelson | |
| 7,322,747 | B2 | 1/2008 | Borchardt | |
| 7,553,082 | B2 * | 6/2009 | Yoder | 383/64 |

(Continued)

*Primary Examiner* — Jes F Pascua

(57) ABSTRACT

A venting closure mechanism for a pouch includes first and second closure profiles that interlock and third and fourth closure profiles that interlock. A sealing flap extends from the first closure element between the first and third closure profiles and engages the second closure element to form a releasable gastight seal therebetween. When the first and second closure elements are occluded, a first plurality of longitudinally spaced first exhaust channels is disposed on a product-side of the sealing flap and a second plurality of longitudinally spaced second exhaust channels is disposed on a user-side of the sealing flap. A first pouch sidewall is attached to the first closure element at an exterior surface thereof between a user-side edge of the first closure element and the sealing flap. An interior surface of the first pouch sidewall is textured with a pattern that provides flow channels therealong.

20 Claims, 8 Drawing Sheets

U.S. PATENT DOCUMENTS

| | | | | |
|---|---|---|---|---|
| 7,674,039 | B2 * | 3/2010 | McMahon et al. | 383/61.2 |
| 7,784,160 | B2 * | 8/2010 | Dais et al. | 24/585.12 |
| 7,857,515 | B2 * | 12/2010 | Dais et al. | 383/59 |
| 7,886,412 | B2 * | 2/2011 | Dais et al. | 24/585.12 |
| 2005/0244083 | A1 | 11/2005 | McMahon et al. | |
| 2007/0110343 | A1 | 5/2007 | Buchman et al. | |
| 2007/0297698 | A1 | 12/2007 | Berich | |
| 2008/0232722 | A1 | 9/2008 | Pawloski et al. | |
| 2009/0324141 | A1 * | 12/2009 | Dais et al. | 383/59 |
| 2011/0097018 | A1 * | 4/2011 | Turvey et al. | 383/63 |

* cited by examiner

VENTING CLOSURE MECHANISM

CROSS REFERENCE TO RELATED APPLICATIONS

This application claims the benefit of U.S. Patent Application Ser. No. 61/080,893, filed Jul. 15, 2008, which is incorporated by reference herein in its entirety.

REFERENCE REGARDING FEDERALLY SPONSORED RESEARCH OR DEVELOPMENT

Not applicable

SEQUENTIAL LISTING

Not applicable

FIELD OF THE INVENTION

The present invention generally relates to a closure mechanism, more particularly, to a resealable closure mechanism that includes a vent mechanism therein.

BACKGROUND OF THE INVENTION

A container that can store contents without unused space within the container facilitates efficient use of storage space. Such a container may be made, for example, of a flexible material, and may, for example, include a mechanism that allows a user to expel excess gas out of the container. The container may also include a resealable closure mechanism that allows a user to repeatedly unseal and seal the container, and the resealable closure mechanism may include the mechanism that allows the user to expel excess gas from the container.

One such closure mechanism is disposed across a main opening in a flexible pouch. A first closure element has a female profile extending from a first base portion thereof that is attached to an interior surface of a first pouch sidewall. A second closure element has a male profile extending from a second base thereof that is attached to an interior surface of an opposite second pouch sidewall. The male profile interlocks with the female profile to occlude the closure mechanism. A flexible leg extends from the first base on a product side of the female profile. An aperture is disposed coincidentally through the first base and the first pouch sidewall between the female profile and the flexible leg. The second base includes a contact surface opposite the flexible leg for forming a seal with the flexible leg when contacted by an end of the flexible leg. The closure mechanism in an occluded state prevents gas from entering the pouch. Increased gas pressure from an interior of the pouch forces the flexible leg out of contact with the contact surface, thereby allowing gas to be forced out of the pouch past the flexible leg and through the aperture. Instead of an aperture through the first base, another closure mechanism has transverse slots cut into the female profile, and the flexible leg and contact surface are on a user side of the male and female profiles. Still another closure mechanism has second male and female closure profiles added on a user side of the flexible leg and the contact surface, and the second female closure profile has transverse slots cut therethrough to allow gas to escape from the pouch.

Another closure mechanism is disposed on a flexible pouch. A first closure element has first and second hooked profiles that extend therefrom and a second closure element has third and fourth hooked profiles that extend therefrom.

The first and second hooked profiles interlock respectively with the third and fourth hooked profiles to engage the first closure element to the second closure element in an occluded closed position, wherein fluid cannot escape from an interior of the pouch. A user may compress the first closure element and the second closure element together to disengage the first and second hooked profiles from the third and fourth hooked profiles, thereby defining an occluded venting position that allows fluid to flow from an interior of the pouch between and past the first and second closure elements to an exterior of the pouch.

Yet another closure mechanism is disposed between first and second opposing pouch sidewalls. The closure mechanism has a first closure element that is releasably engageable to a second closure element. The first closure element has a first fin extending downwardly therefrom, and the second closure element has a second fin extending downwardly therefrom. Each of the first and second fins is sealed to the respective first and second pouch sidewalls and includes a vent disposed therethrough. A top portion of each of the first and second pouch sidewalls overlaps the vent disposed in each respective fin to form a gastight seal between the fin and the sidewall. The top portion of the sidewall may be forcibly separated from the fin by internal gas pressure to allow gas to escape from an interior of the pouch. In another closure mechanism, vents are disposed through each of the first and second pouch sidewalls and are overlapped by the respective first and second fins to form a gastight seal that may be released by internal gas pressure to allow gas to escape from an interior of the pouch.

SUMMARY

According to one aspect of the present invention, a pouch having a closure mechanism includes a first sidewall and a second sidewall, the first and second sidewalls defining an interior of the pouch for containing a product and a mouth for access into the interior. The closure mechanism extends from one end of the mouth to a second end of the mouth to resealably seal the mouth. The closure mechanism includes a first closure profile that extends from an interior surface of a first base of a first closure element and a second closure profile that extends from an interior surface of a second base of a second closure element, wherein the first and second closure profiles interlock to form a seal extending the length of the mouth. The closure mechanism further includes a third closure profile that extends from the interior surface of the first base on a user-side of the first closure profile opposite the interior and a fourth closure profile that extends from the interior surface of the second base on the user-side of the second closure profile, wherein the third and fourth closure profiles interlock to form a seal extending the length of the mouth. The closure mechanism also includes a sealing flap that extends from the interior surface of the first base and is disposed between the first and third closure profiles, wherein the sealing flap engages the interior surface of the second base to form a releasable gastight seal extending the length of the mouth and to allow gas flow only from the interior toward the exterior. A first exhaust channel through at least one of the first base and the second base is disposed between the sealing flap and the first and second closure profiles when the first and second closure elements are occluded, and a second exhaust channel through the closure mechanism is disposed on a user-side of the sealing flap when the first and second closure elements are occluded. The first sidewall is attached to the first base at a first sidewall sealing region disposed on an exterior surface of the first base between a user-side edge of the first base and the sealing flap, wherein an interior surface of the pouch sidewall facing the first exhaust channel is textured with a flow channel between the interior and the first exhaust channel, and the second sidewall is attached to the second base at an exterior surface of the second base. By such arrangement, increased gas pressure in the interior of the pouch when the closure mechanism is occluded causes gas to exhaust from the interior of the pouch through the flow channel, the first exhaust channel, past the sealing flap, and through the second exhaust channel, and whereby the sealing flap prevents gasses from reentering the interior from the exterior when the closure mechanism is occluded. Optionally, the second base may include a sealing surface that extends from the interior surface of the second base between the second and fourth closure profiles and includes a smooth contact surface that engages and seals against the sealing flap. Also optionally, the second exhaust channel may extend through the second base between the second and fourth closure profiles, the second exhaust channel may disposed coincidentally through the second base and the second pouch sidewall, an end portion of the sealing flap may cover the second exhaust channel when the first and second closure elements are occluded, a first plurality of longitudinally spaced first exhaust channels may be disposed through the first base between the sealing flap and the first closure profile, the first base may not be attached to the first sidewall from a product side edge of the first base to the first plurality of longitudinally spaced first exhaust channels and from the first end of the closure mechanism to the second end of the closure mechanism, and the interior surface of the first pouch sidewall may be textured with a pattern that forms flow channels along the interior surface of the first pouch sidewall between the product-side edge of the first base and the first plurality of longitudinally spaced first exhaust channels. In further options, the second base may be attached to the second pouch sidewall at a second sidewall sealing region disposed on an exterior surface of the second base and only between a product-side edge of the second base and the sealing flap when the first and second closure elements are occluded. The pouch may include a second sealing flap that extends from the interior surface of the second base between the second and fourth closure profiles, wherein the second sealing flap engages the interior surface of the first base to form a releasable gastight seal therebetween when the first and second closure elements are occluded. The second exhaust channel may be disposed through the fourth closure profile.

In another aspect of the invention, a pouch with a venting closure mechanism includes a first closure profile that extends from an interior surface of a first base of a first closure element and a second closure profile that extends from an interior surface of a second base of a second closure element, wherein the first and second closure profiles interlock to form a seal therebetween. A third closure profile extends from the interior surface of the first base on a user-side of the first closure profile and a fourth closure profile extends from the interior surface of the second base on a user-side of the second closure profile, wherein the third and fourth closure profiles interlock to form a seal therebetween. A first sealing flap extends from the interior surface of the first base between the first and third closure profiles and toward the first closure profile in a relaxed state, and a second sealing flap extends from the interior surface of the second base between the second and fourth closure profiles and toward the fourth closure profile in a relaxed state, wherein the first sealing flap engages the second sealing flap to form a releasable gastight seal therebetween. A first plurality of longitudinally spaced first exhaust channels is disposed on a product-side of the first and second sealing flaps when the first and second closure elements are occluded, and a second plurality of longitudinally spaced second exhaust channels is disposed on a user-side of the first and second sealing flaps when the first and second closure elements are occluded. A first pouch sidewall is attached to the first base at a first sidewall sealing region disposed on an exterior surface of the first base between a user-side edge of the first base and the first sealing flap, and a second pouch sidewall is attached to the second base at an exterior surface of the second base. The first plurality of longitudinally spaced first exhaust channels may be disposed through the first base between the first sealing flap and the first closure profile. The second plurality of longitudinally spaced second exhaust channels may be disposed coincidentally through the first base and the first pouch sidewall between the first sealing flap and the second closure profile. The second plurality of longitudinally spaced second exhaust channels may be disposed through the second base between the second and fourth closure profiles, and the second base may be attached to the second pouch sidewall at a second sidewall sealing region disposed on an exterior surface of the second base between a product-side edge of the second base and the second sealing flap. The second plurality of longitudinally spaced second exhaust channels may be disposed through the third closure profile. The first plurality of longitudinally spaced first exhaust channels may be disposed through the first closure profile, and an interior surface of the first pouch sidewall may be textured with a pattern that provides flow channels along the interior surface of the first pouch sidewall. Further, the first and second sealing flaps may be each substantially linear in cross section, and a contact area where the first sealing flap contacts the second sealing flap may comprise a tacky surface.

In a further aspect of the present invention, a pouch with a venting closure mechanism includes a first closure profile that extends from an interior surface of a first base of a first closure element and a second closure profile that extends from an interior surface of a second base of a second closure element, wherein the first and second closure profiles interlock to form a gastight seal therebetween, a third closure profile that extends from the interior surface of the first base on a user-side of the first closure profile and a fourth closure profile that extends from the interior surface of the second base on a user-side of the second closure profile, wherein the third and fourth closure profiles interlock to form a gastight seal therebetween, a first sealing flap that extends from the interior surface of the first base between the first and third closure profiles and toward the third closure profile in a relaxed state and a second sealing flap that extends from the interior surface of the second base between the second and fourth closure profiles and toward the fourth closure profile in a relaxed state, wherein the first sealing flap engages the second sealing flap to form a releasable gastight seal therebetween, and a first plurality of longitudinally spaced first exhaust channels disposed on a product-side of the first and second sealing flaps when the first and second closure elements are occluded and a second plurality of longitudinally spaced second exhaust channels disposed on a user-side of the first and second sealing flaps when the first and second closure elements are occluded. A first pouch sidewall is attached to the first base at a first sidewall sealing region disposed on an exterior surface of the first base between a user-side edge of the first base and the first sealing flap, and a second pouch sidewall is attached to the second base at an exterior surface of the second base. The first plurality of longitudinally spaced first exhaust channels may be disposed through the first base, and an interior surface of the first pouch sidewall may be textured with a pattern that provides flow channels along the interior surface of the first pouch sidewall.

BRIEF DESCRIPTION OF THE DRAWINGS

Other aspects and advantages of the present disclosure will become apparent upon consideration of the following detailed description, wherein similar structures have similar reference numbers.

DETAILED DESCRIPTION

Figure 1:
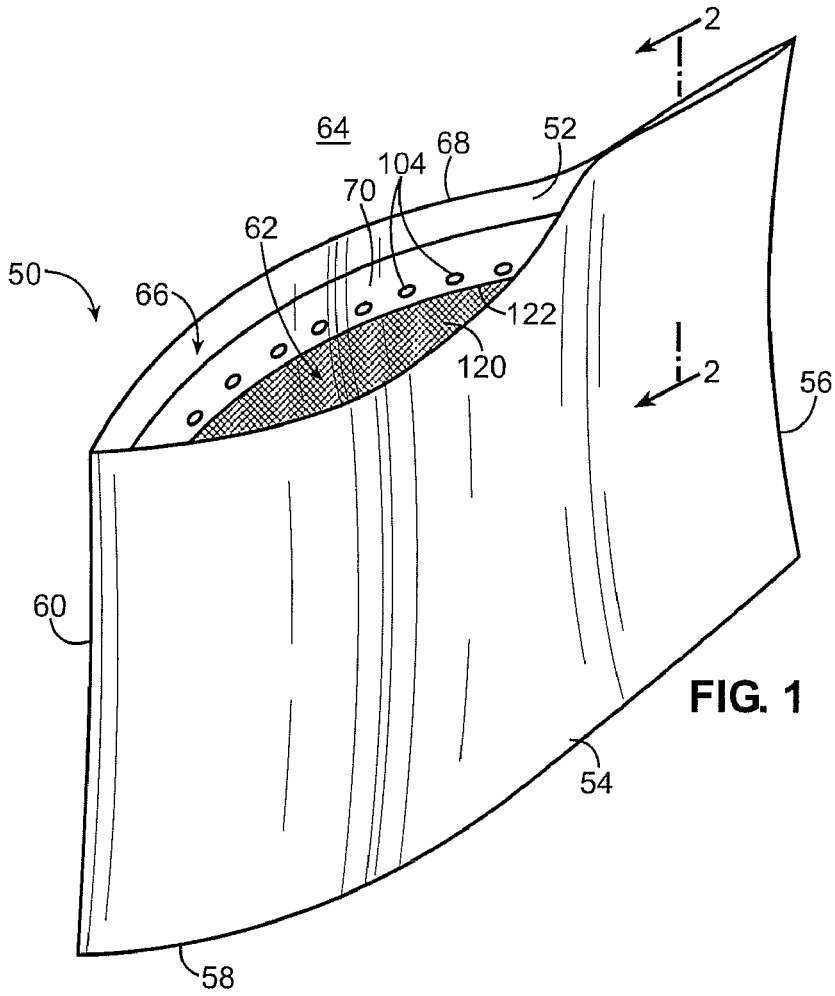
FIG. 1 is an isometric view of a pouch having a closure mechanism.

The present disclosure is directed to a closure mechanism that includes a venting mechanism within the closure mechanism. While specific embodiments are discussed herein, it is understood that the present disclosure is to be considered only as an exemplification of the principles of the invention. For example, where the disclosure is illustrated herein with particular reference to gastight product-side and user-side closure profiles, it will be understood that each refers to any number of gastight closure profiles, including one or more. Also, where the disclosure is illustrated herein with a single first sealing flap disposed on a first closure element and a single second sealing flap disposed on a second closure element, it will be understood that any number of the first sealing flaps, including none, one or more, could be disposed on the first or second closure elements and that any number of the second sealing flaps, including none, one or more, could be disposed on the first or second closure elements. Therefore, the present disclosure is not intended to limit the disclosure to the embodiments illustrated.

In accordance with one aspect of the disclosure, a flexible pouch includes first and second sidewalls and a resealable closure mechanism for sealing a mouth thereof. A first closure profile extends from an interior surface of a first closure element and a second closure profile extends from an interior surface of a second closure element. When the first and second closure elements are occluded, the first and second closure profiles engage to form a seal along the length of the occlusion. The first closure element further includes a first sealing flap extending from the interior surface thereof and disposed on a user-side of the first closure profile. The second closure element further includes a second sealing flap extending from the interior surface thereof and disposed on a user-side of the second closure profile. In an occluded state, the first and second sealing flaps engage to form a releasable gastight seal therebetween. The first sidewall is attached to an exterior surface of the first closure element along a first sidewall sealing region approximately disposed between a user-side end of the first closure element and the first sealing flap. A plurality of longitudinally spaced first exhaust channels is disposed through the first closure element between the first sidewall sealing region and the first closure profile. An exterior surface of the second closure element is attached to the second sidewall. A plurality of longitudinally spaced second exhaust channels disposed on a user-side of the first and second sealing flaps provides fluid communication between the first and second sealing flaps and an exterior of the flexible pouch. To remove gas from the flexible pouch, a user occludes the closure mechanism and subsequently applies an inward force on the sidewalls to increase gas pressure inside of the pouch. This increased internal pressure of the pouch, in one embodiment, forces a portion of the first sidewall proximate to the plurality of longitudinally spaced first exhaust channels away from the first closure element. Gas may flow from a region of increased pressure in an interior of the pouch through the plurality of longitudinally spaced first exhaust channels and into a space within the closure mechanism between the first and second sealing flaps and the first and second closure profiles. Increased gas pressure within the space forces open the releasable gastight seal between the first and second sealing flaps and allows the gas to escape through the plurality of longitudinally spaced second exhaust channels to an exterior of the pouch.

Turning now to the drawings, FIG. 1 illustrates a reclosable pouch 50 having a first sidewall 52 and a second sidewall 54 that are connected by, for example, folding, heat sealing, and/or an adhesive, along three peripheral edges 56, 58, 60 to define an interior space 62 between the first and second sidewalls 52, 54, an exterior space 64, and an opening 66 along a top edge 68 where the first and second sidewalls 52, 54 are not connected so as to allow access to the interior space 62 from the exterior space 64. A resealable closure mechanism 70 is disposed along the first and second sidewalls 52, 54 near the opening 66 and extends between the peripheral edge 56 and the peripheral edge 60 of the pouch 50 to allow the opening 66 to be repeatedly occluded and deoccluded, thereby respectively sealing and unsealing the opening 66.

Referring to embodiments depicted in FIGS. 2A-2E, the resealable closure mechanism 70 includes a first closure element 72 that releasably interlocks with an opposing second closure element 74. Illustratively, each of the first and second closure elements 72, 74 has a substantially constant elongate cross-sectional profile that extends longitudinally between the peripheral edge 56 and the peripheral edge 60 of the pouch 50 to form a continuous gastight seal therealong when fully interlocked with the opposing closure element. The first closure element 72 includes a first base 76. First product-side and user-side closure profiles 78, 80 extend from an interior surface 82 of the first base 76. Second product-side and user-side closure profiles 84, 86 extend from an interior surface 88 of a second base 90 of the second closure element 74. Each of the first product-side and user-side closure profiles 78, 80 interlockingly engage with the second product-side and user-side closure profiles 84, 86, respectively, to form a gastight seal therebetween, when the first and second closure elements 72, 74 are in an occluded state.

Figure 2A:
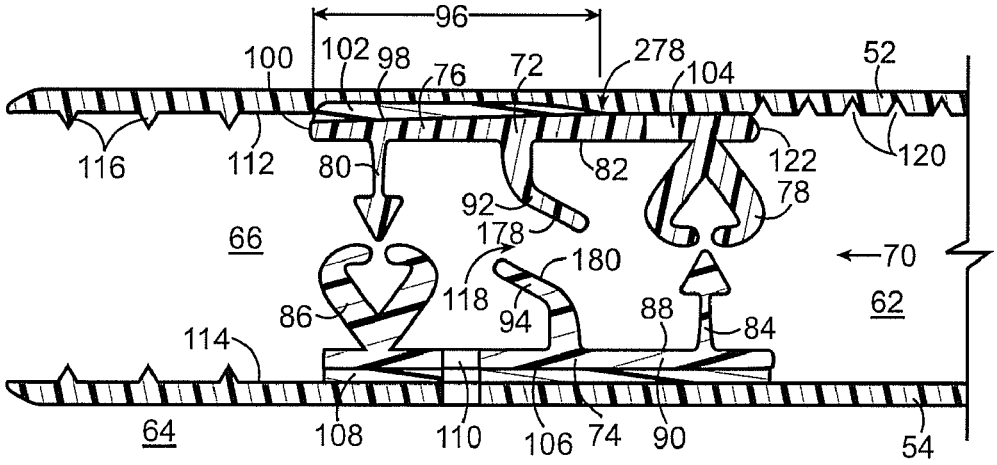
FIG. 2A is a cross sectional view of an embodiment of a closure mechanism in an unoccluded state, taken generally along the lines 2-2 of FIG. 1 with portions behind the plane of the cross section omitted for clarity.
Figure 2B:
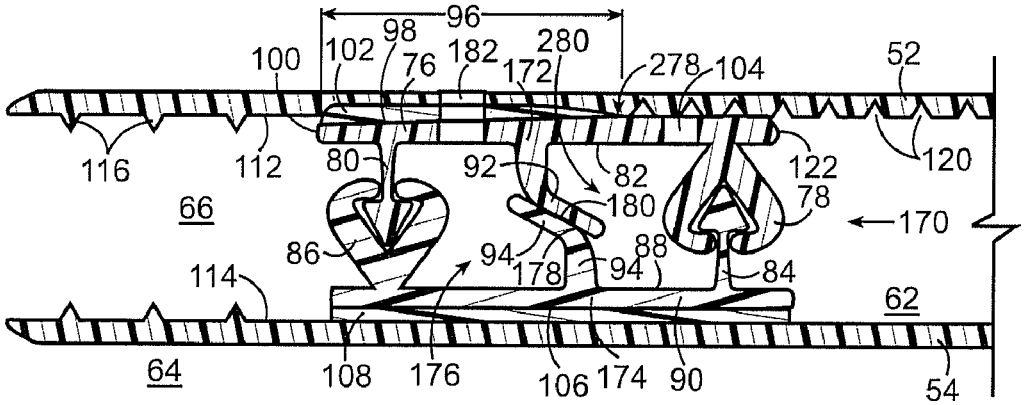
FIG. 2B is a cross sectional view of another embodiment of a closure mechanism in a first sealed state, taken generally along the lines 2-2 of FIG. 1 with portions behind the plane of the cross section omitted for clarity.
Figure 2C:
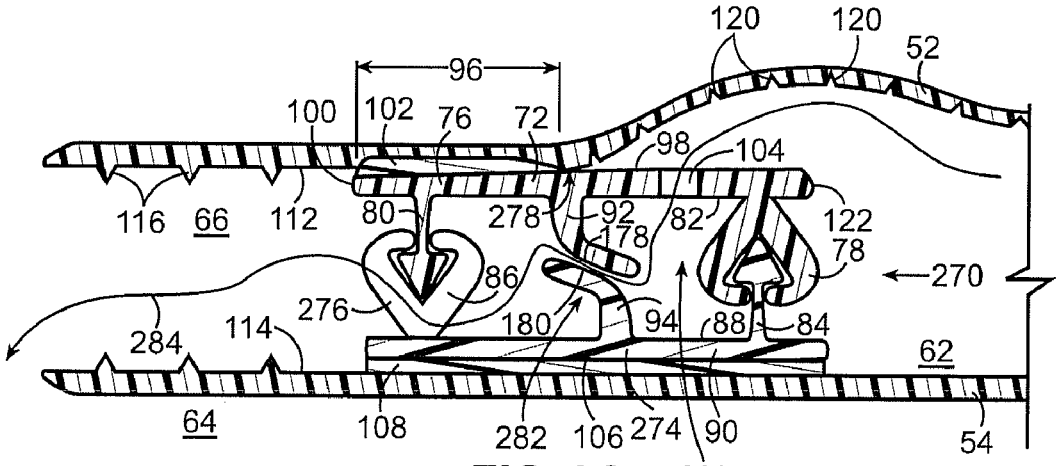
FIG. 2C is a cross sectional view of a further embodiment of a closure mechanism depicted during expulsion of gas in a first open state, taken generally along the lines 2-2 of FIG. 1 with portions behind the plane of the cross section omitted for clarity.
Figure 2D:
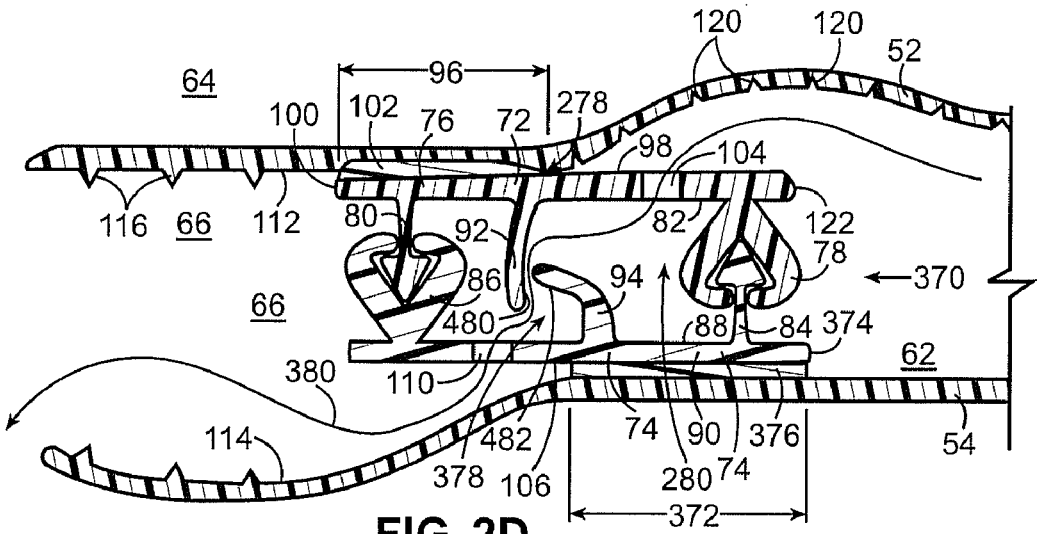
FIG. 2D is a cross sectional view of yet another embodiment of a closure mechanism depicted during expulsion of gas in a second open state, taken generally along the lines 2-2 of FIG. 1 with portions behind the plane of the cross section omitted for clarity.
Figure 2E:
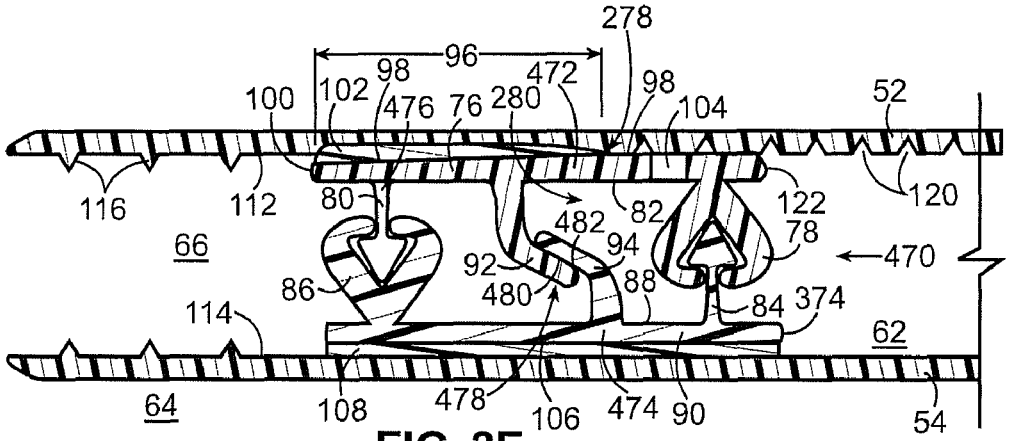
FIG. 2E is a cross sectional view of still another embodiment of a closure mechanism in a second sealed state, taken generally along the lines 2-2 of FIG. 1 with portions behind the plane of the cross section omitted for clarity.
Figure 3A:
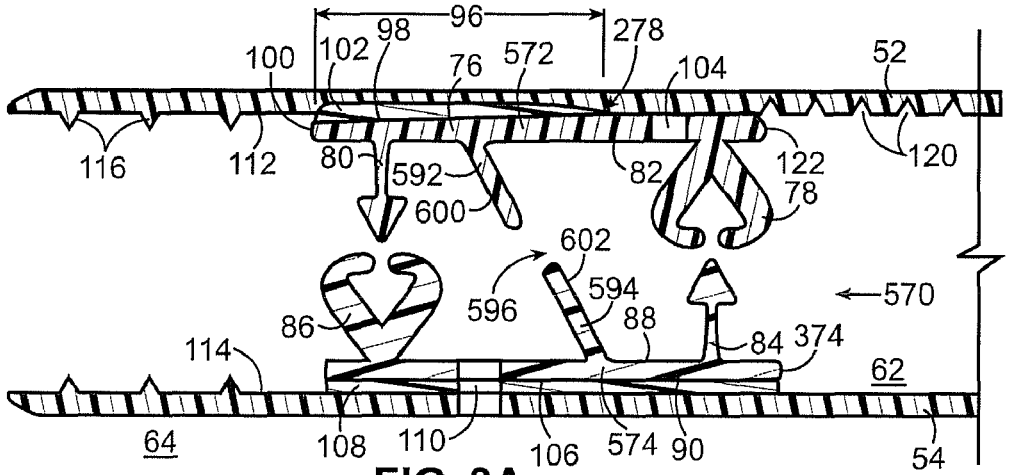
FIG. 3A is a cross sectional view of another embodiment of a closure mechanism in an unoccluded state, taken generally along the lines 2-2 of FIG. 1 with portions behind the plane of the cross section omitted for clarity.

A first sealing flap 92 extends from the interior side 82 of the first base 76 generally toward the first product-side closure profile 78 in a relaxed state, as illustrated in FIGS. 2A and 3A, and is disposed between the first product-side and user-side closure profiles 78, 80. A second sealing flap 94 extends from the interior side 88 of the second base 90 generally toward the second user-side closure profile 86 in a relaxed state as illustrated in FIGS. 2A and 3A, and is disposed between the second product-side and user-side closure profiles 84, 86. The first closure element 72 is attached to the first sidewall 52 at a first sidewall sealing region 96 disposed on an exterior surface 98 of the first closure element 72 and approximately between a user-side end 100 of the first closure element 72 and the first sealing flap 92. The first sidewall sealing region 96 may be attached to the first sidewall 52, for example, by a thermoplastic weld layer 102, by a direct weld, by an adhesive, or by another method of attachment known by those skilled in the art. A plurality of longitudinally spaced first exhaust channels, for example a plurality of first vent holes 104 as depicted in FIGS. 1 and 2A-2E, is disposed through the first closure element 72 between the first sidewall sealing region 96 and the first product-side closure profile 78. Although not shown, it is contemplated that the plurality of first exhaust channels 104 may also be disposed through one or more of the first and second product-side closure profiles 78, 84 so as to provide fluid communication between the interior space 62 and the exterior space 64 of the pouch 50. An exterior surface 106 of the second closure element 74 is attached to the second sidewall 54, for example, by a thermoplastic weld layer 108, or another method known to those skilled in the art.

One or more second exhaust channels disposed in the closure mechanism 70 provide fluid communication between the first and second sealing flaps 92, 94 and the exterior space 64 of the pouch 50. In the embodiment depicted in FIG. 2A, one or more second exhaust channels, for example a plurality of longitudinally spaced second vent holes 110 is coincidentally disposed through the second closure element 74, the thermoplastic weld layer 108, and the second sidewall 54 between the second sealing flap 94 and the second user-side closure profile 86. Interior surfaces 112, 114 of the first and second sidewalls 52, 54 may include grip ridges 116 that extend between the peripheral edge 56 and the peripheral edge 60 of the pouch 50 to allow a user to get a better grasp on the pouch.

FIG. 2A depicts an embodiment of the resealable closure mechanism 70 in an unoccluded state with the first sealing flap 92 and the second sealing flap 94 in a first relaxed state 118. Optionally, one or both surfaces of a sidewall, for example, the interior surface 112 of the first sidewall 52, may be embossed or textured with a pattern 120, as schematically depicted in FIGS. 1 and 2A, between the bottom side edge 58 and a product-side end 122 of the first closure element 72, or a separate textured or embossed patterned wall (not shown) may be provided within the pouch interior 62. In other embodiments, the textured pattern 120 may be omitted such that the interior surfaces of the sidewalls are smooth. The textured pattern 120 provides flow channels that allow fluid communication between a remote portion of the pouch interior 62 and a portion of the pouch interior proximate to the closure mechanism 70, and may facilitate evacuation of gas from the pouch interior 62. In this embodiment, the textured pattern 120 does not extend beyond the product-side end 122 of the first closure element 72 so that a portion of the first sidewall 52 that covers the plurality of first vent holes 104 may form a gastight seal against the exterior surface 98 of the first base 76. Illustrative flow channels useful in the present invention include those disclosed in Zimmerman et al. U.S. Patent Application Publication No. 2005/0286808 and Tilman et al. U.S. Pat. No. 7,290,660. Other flow channels useful in the present invention include those disclosed in, for example, U.S. patent application Ser. No. 11/818,584, filed Jun. 15, 2007.

Another embodiment of a resealable closure mechanism 170, as depicted in FIG. 2B, illustrates initial occlusion of first and second closure elements 172, 174. The first sealing flap 92 and the second sealing flap 94 are forced against one another in a first sealed state 176. In particular, a first contact surface 178 on the first sealing flap 92 engages and forms a gastight seal against a second contact surface 180 on the second sealing flap 94. This embodiment is similar to the embodiment described with regard to FIG. 2A, except for the following differences. The second closure element 174 does not include the plurality of second vent holes 110. Instead, the one or more second exhaust channels in this embodiment are exemplified by a plurality of longitudinally spaced second vent holes 182 that is coincidentally disposed through the first closure element 172, the thermoplastic weld layer 102, and the first sidewall 52 between the first sealing flap 92 and the first user-side closure profile 80. The plurality of second vent holes 182 provides fluid communication between the first and second sealing flaps 92, 94 and the exterior 64 of the pouch 50. Also, in this embodiment, the textured pattern 120 extends beyond the product-side end 122 of the first closure element 72 up to a product-side edge 278 of the first sidewall sealing region 96.

Application of increased internal pressure to the pouch 50 results in separation of the first sidewall 52 from the exterior surface 98 of the first base 76, as depicted in FIG. 2C. Pressurized gas flows from an interior of the pouch 50 through the plurality of first vent holes 104 into a space 280, shown in FIGS. 2B-2E, within the closure mechanism 270 between the first and second sealing flaps 92, 94 and the first and second product-side closure profiles 78, 84.

FIG. 2C depicts a further embodiment of a resealable closure mechanism 270. This embodiment is similar to the embodiment described with regard to FIG. 2B, except for the following differences. The first closure element 72 lacks the plurality of second vent holes 182. In this embodiment, the one or more second exhaust channels are illustrated by a plurality of notches 276 disposed through the second user-side closure profile 86. The plurality of notches 276 provides fluid communication between the first and second sealing flaps 92, 94 and the exterior 64 of the pouch 50. Illustrative exhaust channels disposed through a closure profile that may be useful in the present invention include those disclosed in Nelson U.S. Pat. Nos. 6,692,147 and 7,270,479.

In some embodiments, the pressurized gas within the space 280 may force the second contact surface 180 to separate from the first contact surface 178 and break the gastight seal therebetween in a first open state 282, as depicted in FIG. 2C. Separation of the first and second contact surfaces 178, 180 into a first open state 282 allows gas to escape from the interior 62 of the pouch 50 to the exterior 64 of the pouch along a path represented schematically by an arrow 284.

FIG. 2D depicts yet another embodiment of a resealable closure mechanism 370. This embodiment is similar to the embodiment described with regard to FIG. 2A, except for the following differences. In this embodiment, the textured pattern 120 extends beyond the product-side end 122 of the first closure element 72 up to a product-side edge 278 of the first sidewall sealing region 96. Further, the second closure element 74 is attached to the second sidewall 54 at a second sidewall sealing region 372 disposed on an exterior surface 106 of the second closure element 74 and approximately between a product-side end 374 of the second closure element 74 and the second sealing flap 94. The second sidewall sealing region 372 may be attached to the second sidewall 54, for example, by a thermoplastic weld layer 376, by a direct weld, by an adhesive, or by another method of attachment known by those skilled in the art. A portion of the second sidewall 54 that covers the plurality of second vent holes 110 may form a gastight seal against the exterior surface 106 of the second base 90. Illustrative sealable vent holes in closure elements and/or sidewalls that may be useful in the present invention include those disclosed in Dobreski et al. U.S. Pat. Nos. 5,911,508 and 6,010,244.

In some embodiments, the pressurized gas within the space 280 may force the first sealing flap 92 to snap past the second sealing flap 94 into a second open state 378, as depicted in FIG. 2D. In the second open state 378, fluid communication between the interior 62 of the pouch 50 and the exterior 64 of the pouch allows gas to exit the pouch, as schematically indicated by an arrow 380.

Still another embodiment of a resealable closure mechanism 470 is depicted in FIG. 2E. This embodiment is similar to the embodiment described with regard to FIG. 2C, except for the following differences. A second closure element 474 lacks the plurality of notches 276 disposed through the second user-side closure profile 86. In this embodiment, the one or more second exhaust channels are exemplified by a plurality of notches 476 disposed through the first user-side closure profile 80. The plurality of notches 476 provides fluid communication between the first and second sealing flaps 92, 94 and the exterior 64 of the pouch 50.

In embodiments where pressure causes the first sealing flap 92 to snap past the second sealing flap 94 into a second open state 378, as depicted in FIG. 2D, subsequent release of excess gas pressure from within the pouch 50 may allow the first and second sealing flaps 92, 94 to resiliently flex into a second sealed state 478. In particular, a third contact surface 480 on the first sealing flap 92 engages and forms a gastight seal against a fourth contact surface 482 on the second sealing flap 94. In addition, the closure mechanism 70 in the embodiment shown in FIG. 2A, for example, may be formed such that the sealing flaps 92 and 94 engage at contact surfaces 480 and 482 as shown in the embodiment of FIG. 2E when the closure elements 72 and 74 are initially occluded. Following the succession of states depicted in FIGS. 2A-2E, the closure mechanism 70, 170, 270, 370, 470 is occluded and excessive gas within the pouch 50 is expelled.

The first and second product-side closure profiles 78, 84 and the first and second user-side closure profiles 80, 86 may include any type of interlocking profiles such as the male and female closure profiles, as shown in FIGS. 2A-2E. However, the configuration and geometry of the closure profiles 78, 80, 84, 86 disclosed herein may vary as known to one having ordinary skill in the art. In another embodiment, a sealing material such as a polyolefin material or a caulking composition such as silicone oil or grease may be disposed on or in the closure elements 72, 74, for example, between the first product-side and user-side profiles 78, 80 and the second product-side and user-side profiles 84, 86, respectively. A sealing material may also be disposed along the contact surfaces 178 and/or 480 of the first sealing flap 92 and/or the contact surfaces 180 and/or 482 of the second sealing flap 94. A sealing material may also be disposed on the exterior surface 98 around the plurality of first vent holes 104 through the first closure element 72 and/or on the exterior surface 106 around the plurality of second vent holes 110 through the second closure element 74. The first and second closure elements 72, 74 may also be welded or sealed to one another at ends thereof, for example, by ultrasonic vibrations, or as is known in the art. Illustrative interlocking closure profiles, closure elements, sealing materials, and/or end seals useful in the present invention include those disclosed in, for example, Pawloski U.S. Pat. No. 4,927,474, Dais et al. U.S. Pat. Nos. 5,070,584, 5,478,228, and 6,021,557, Tomic et al. U.S. Pat. No. 5,655,273, Sprehe U.S. Pat. No. 6,954,969, Kasai et al. U.S. Pat. No. 5,689,866, Ausnit U.S. Pat. No. 6,185,796, Wright et al. U.S. Pat. No. 7,041,249, Pawloski et al. U.S. Pat. No. 7,137,736, Anderson U.S. Pat. No. 7,305,742, Pawloski U.S. Patent Application Publication No. 2004/0234172, Tilman et al. U.S. Pat. No. 7,290,660, and Anzini et al. U.S.

Patent Application Publication Nos. 2006/0093242 and 2006/0111226. Other interlocking profiles and closure elements useful in the present invention include those disclosed in, for example, U.S. patent application Ser. No. 11/725,120, filed Mar. 16, 2007, U.S. patent application Ser. No. 11/818,585, filed Jun. 15, 2007, U.S. patent application Ser. No. 11/818,586, filed Jun. 15, 2007, and U.S. patent application Ser. No. 11/818,593, filed Jun. 15, 2007.

In a further embodiment, a resealable closure mechanism 570 includes a first closure element 572 and an opposing second closure element 574, as shown in FIG. 3A. This embodiment, and further embodiments depicted in FIGS. 3B-3E are substantially similar to the embodiments disclosed above with regard to FIGS. 2A-2E, respectively, except that the first and second sealing flaps 92 and 94 have been replaced by first and second sealing flaps 592, 594 that are each substantially linear in cross section and may extend at an angle of other than about 90 degrees from the respective first and second bases 76, 90. FIG. 3A depicts the resealable closure mechanism 570 in an unoccluded state with the sealing flap 592 and the sealing flap 594 in a first relaxed state 596.

Figure 3B:
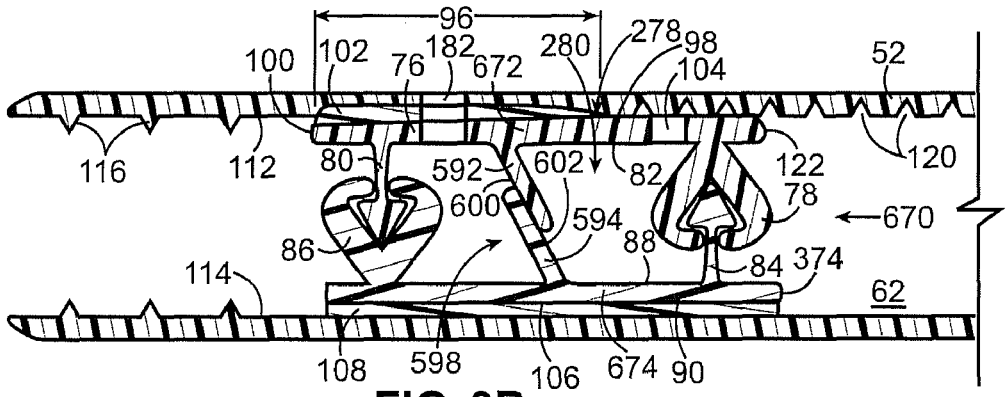
FIG. 3B is a cross sectional view of a further embodiment of a closure mechanism in a first sealed state, taken generally along the lines 2-2 of FIG. I with portions behind the plane of the cross section omitted for clarity.

Another embodiment of a resealable closure mechanism 670 is depicted in FIG. 3B and illustrates initial occlusion of first and second closure elements 672, 674. Upon initial occlusion of the first and second closure elements 672, 674, the first sealing flap 592 and the second sealing flap 594 are forced against one another in a first sealed state 598, as shown in FIG. 3B. In this first sealed state 598, first and second contact surfaces 600, 602 of the first and second sealing flaps 592, 594, respectively, engage one another to form a gastight seal therebetween.

Figure 3C:
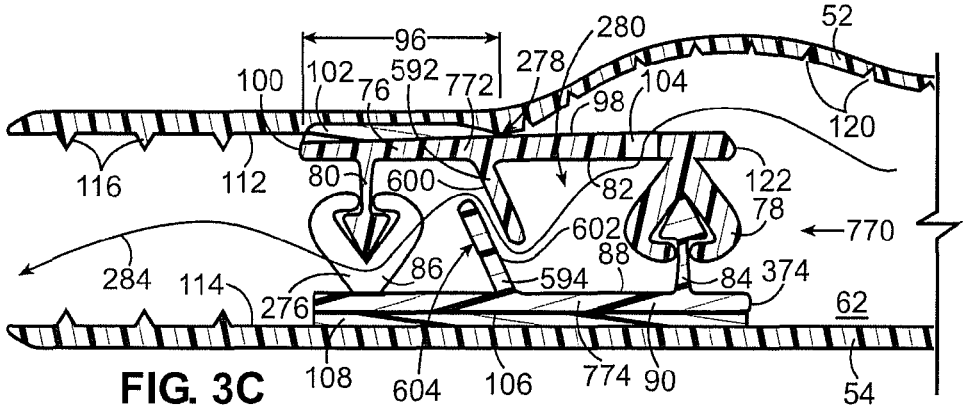
FIG. 3C is a cross sectional view of another embodiment of a closure mechanism depicted during expulsion of gas in a first open state, taken generally along the lines 2-2 of FIG. 1 with portions behind the plane of the cross section omitted for clarity.

An embodiment of another resealable closure mechanism 770 is depicted in FIG. 3C. Separation of the first sidewall 52 from the exterior surface 98 of the first base 76 caused by application of increased internal pressure to the pouch 50 allows pressurized gas to flow from an interior of the pouch 50 through the plurality of first vent holes 104 into the space 280 between the first and second sealing flaps 592, 594 and the first and second product-side closure profiles 78, 84. In the embodiment shown in FIG. 3C, the pressurized gas within the space 280 may force the second contact surface 602 to separate from the first contact surface 600 and break the gastight seal therebetween in a first open state 604 that allows gas to escape from the interior 62 of the pouch 50 to the exterior 64 of the pouch along the path represented schematically by the arrow 284.

Figure 3D:
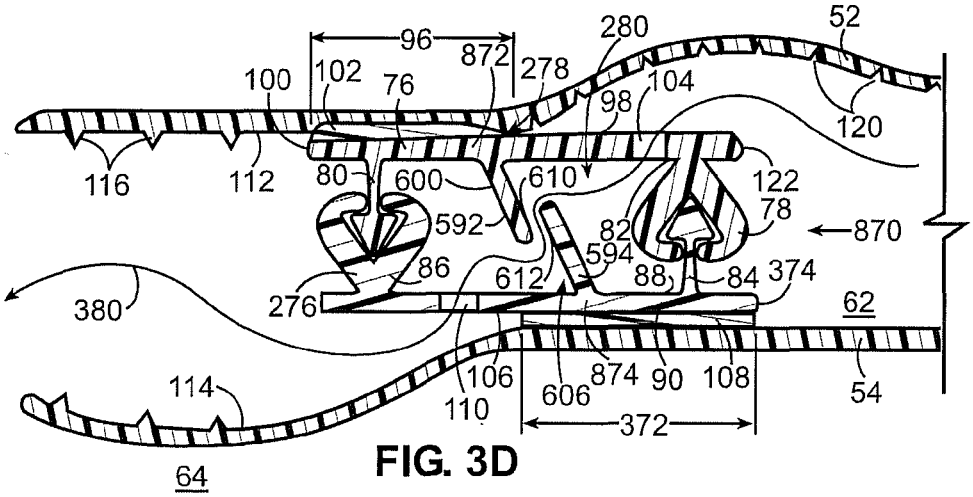
FIG. 3D is a cross sectional view of yet another embodiment of a closure mechanism depicted during expulsion of gas in a second open state, taken generally along the lines 2-2 of FIG. 1 with portions behind the plane of the cross section omitted for clarity.

In a further embodiment, a resealable closure mechanism 870 comprises first and second closure elements 872, 874, as depicted in FIG. 3D. In this embodiment, pressurized gas within the space 280 may force the first sealing flap 592 to snap past the second sealing flap 594 into a second open state 606 that provides fluid communication between the interior of the pouch 50 and the plurality of second vent holes 110 to allow gas to exit the pouch 50, as indicated by the curved arrow 380.

Figure 3E:
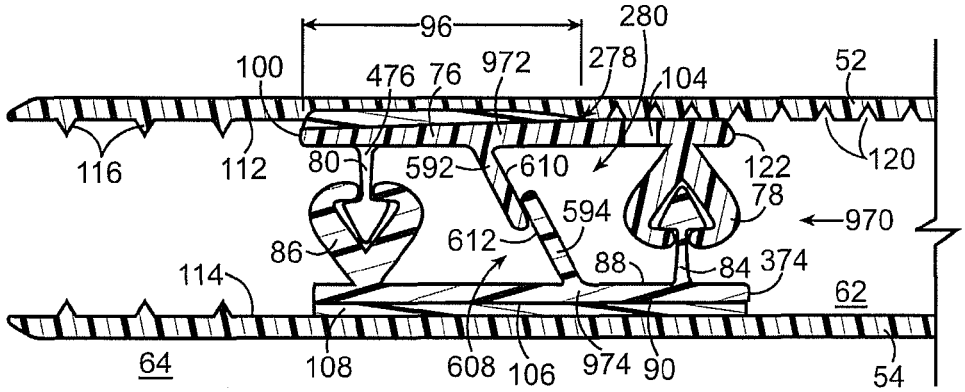
FIG. 3E is a cross sectional view of still another embodiment of a closure mechanism in a second sealed state, taken generally along the lines 2-2 of FIG. 1 with portions behind the plane of the cross section omitted for clarity.

In yet another embodiment, a resealable closure mechanism 970 comprises first and second closure elements 972, 974, as depicted in FIG. 3E. Subsequent to release of excess gas pressure by the closure mechanism 870 in the second open state 606 depicted in FIG. 3D, the first and second sealing flaps 592, 594 may resiliently flex into a second sealed state 608, as depicted in the embodiment shown in FIG. 3E. A third contact surface 610 of the first sealing flap 592 engages a fourth contact surface 612 and the second sealing flap 594 to form a gastight seal therebetween.

Figure 4A:
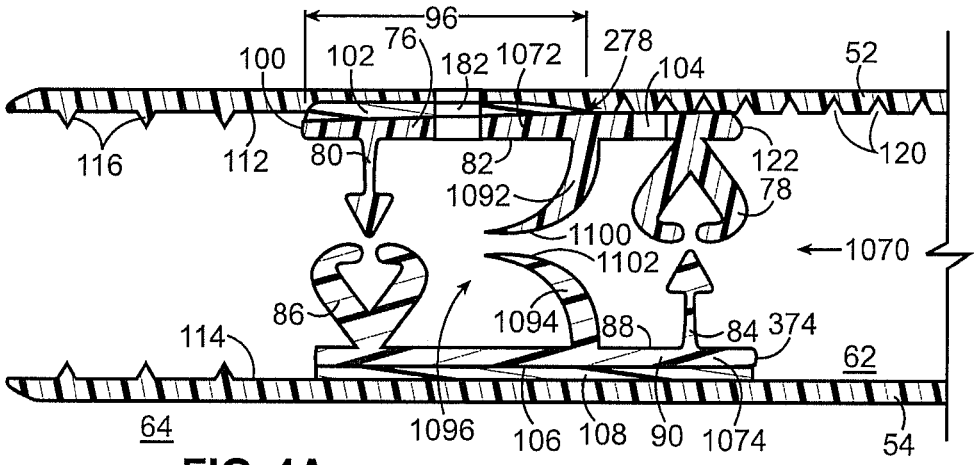
FIG. 4A is a cross sectional view of a further embodiment of a closure mechanism in an unoccluded state, taken generally along the lines 2-2 of FIG. 1 with portions behind the plane of the cross section omitted for clarity.
Figure 4B:
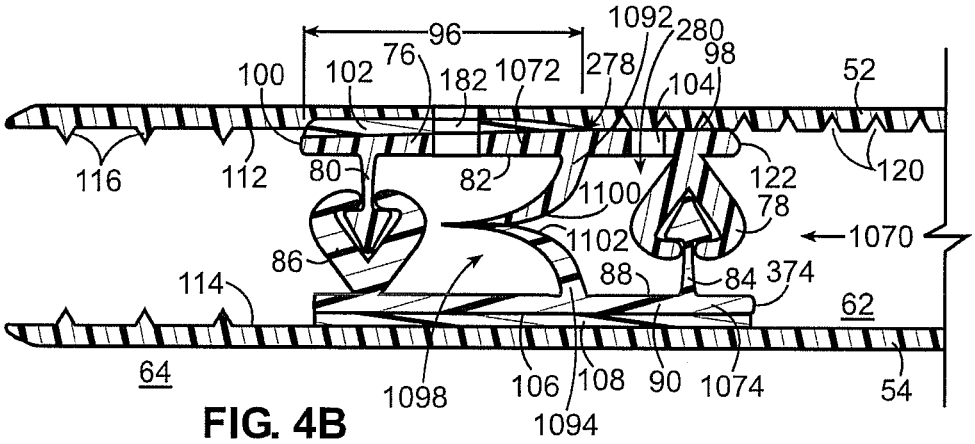
FIG. 4B is a cross sectional view of the closure mechanism of FIG. 4A in a sealed state, taken generally along the lines 2-2 of FIG. 1 with portions behind the plane of the cross section omitted for clarity.
Figure 4C:
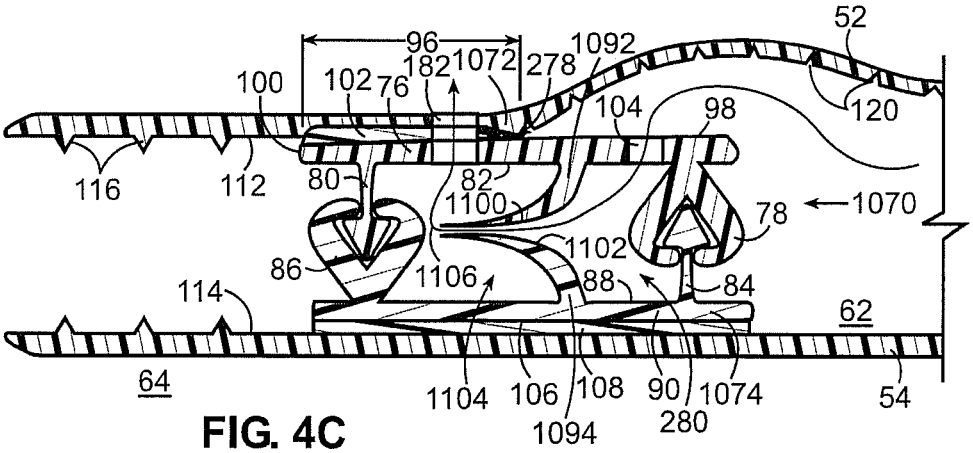
FIG. 4C is a cross sectional view of the closure mechanism of FIG. 4A depicted during expulsion of gas in an open state, taken generally along the lines 2-2 of FIG. 1 with portions behind the plane of the cross section omitted for clarity.

In another embodiment, a resealable closure mechanism 1070 includes a first closure element 1072 and an opposing second closure element 1074, as shown in FIGS. 4A-4C. This embodiment is similar to the embodiment disclosed above with regard to FIG. 3B except that the first and second sealing flaps 592 and 594 have been replaced by first and second sealing flaps 1092, 1094 that each may be substantially linear or curvilinear in cross section and extend at an angle of other than 90 degrees from the respective first and second bases 76, 90 and generally toward the first and second user-side closure profiles 80, 86.

FIG. 4A depicts the resealable closure mechanism 1070 in an unoccluded state with the first and second sealing flaps 1092, 1094 in a first relaxed state 1096. Upon occlusion of the first and second closure elements 1072, 1074, the first and second sealing flaps 1092, 1094 are forced against one another in a sealed state 1098, in which first and second contact surfaces 1100, 1102 of the first and second sealing flaps 1092, 1094, respectively, engage one another to form a gastight seal therebetween, as depicted in FIG. 4B.

The first sidewall 52 separates from the exterior surface 98 of the first base 76 upon application of increased internal pressure to the pouch 50, as depicted in FIG. 4C. Pressurized gas flows from the interior of the pouch 50 through the plurality of first vent holes 104 into the space 280 between the first and second sealing flaps 1092, 1094 and the first and second product-side closure profiles 78, 84. The pressurized gas forces the first and second sealing flaps 1092, 1094 into an open state 1104, as depicted in FIG. 4C, in which fluid communication between the interior of the pouch 50 and the plurality of second vent holes 110 allows gas to exit the pouch 50, as indicated by the curved arrow 1106. Subsequent to release of excess gas pressure from within the pouch 50, the first and second sealing flaps 1092, 1094 may resiliently return to the sealed state 1098.

Figure 5:
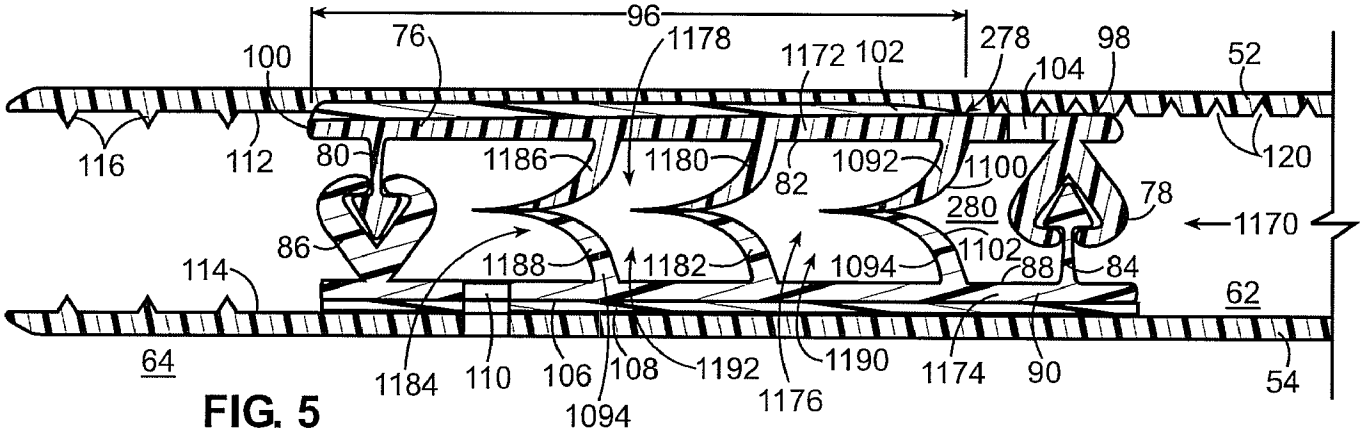
FIG. 5 is a cross sectional view of another embodiment of a closure mechanism, taken generally along the lines 2-2 of FIG. 1 with portions behind the plane of the cross section omitted for clarity.

FIG. 5 illustrates a further embodiment of a resealable closure mechanism 1170 including first and second closure elements 1172, 1174 that is substantially similar to the embodiment described with regard to FIGS. 4A-4C except for the following differences. In addition to a first set 1176 of sealing flaps defined by the first and second sealing flaps 1092, 1094, the resealable closure mechanism 1170 also includes a second set 1178 of sealing flaps defined by third and fourth sealing flaps 1180, 1182 and a third set 1184 of sealing flaps defined by fifth and sixth sealing flaps 1186, 1188. In addition, the one or more second exhaust channels are illustrated in this embodiment by the plurality of second vent holes 110 coincidentally disposed through the second closure element 1174, the thermoplastic weld layer 108, and the second sidewall 54 between the sixth sealing flap 1188 and the second user-side closure profile 86. The additional sealing flaps 1180, 1182, 1186, 1188 are illustrated as each having a cross section similar to that shown in regard to FIGS. 4A-4C, but the additional sealing flaps 1180, 1182, 1186, 1188 may have any cross section as hereinabove described or as known to one having skill in the art. The first, second, and third sets 1176, 1184, and 1186 of sealing flaps may have similar cross sections to one another, or may have different cross sections as desired or as may be needed. In other embodiments not shown, one or more of the sealing flaps 1092, 1094, 1180, 1182, 1186, 1188 may extend at an angle of about 90 degrees or an angle other than about 90 degrees from corresponding first and second closure elements.

A second space 1190 is defined between the first and second sets 1176, 1178 of sealing flaps. Similarly, a third space 1192 is defined between the second and third sets 1178, 1184 of sealing flaps. The first, second, and third sets 1176, 1178, and 1184 of sealing flaps may facilitate an enhanced seal against increased pressure from the pouch interior 62 by sealing each of the spaces 280, 1190, and 1192 successively.

Although not shown, it is also contemplated that a vacuum device may be used to evacuate gas from the interior 62 of the pouch 50. For example, referring to FIGS. 2B and 3B, a vacuum device such as a manual or electric vacuum pump may be configured to be placed over the plurality of second vent holes 182. Flow channels provided by the textured pattern 120 may allow fluid communication between a remote portion of the pouch interior 62 and the space 280. A vacuum drawn on the plurality of second vent holes 182 may result in a pressure drop across the first and second sealing flaps 92, 94 (or 592, 594) from the space 280 to the plurality of second vent holes 182. If sufficiently large, this pressure drop breaks the gastight seal between the first and second sealing flaps 92, 94 (or 592, 594) as described hereinabove, and allows gas to escape from the interior 62 through the plurality of second vent holes 182. The gas may flow from the interior 62 through, for example, the plurality of first vent holes 104 via the flow channels provided by the textured pattern 120 or through gaps that may exist between the first and second product side profiles 78, 84 if the first and second product side profiles 78, 84 are not gastight when occluded. Likewise, referring to FIG. 5, a vacuum device may be configured to be placed over the plurality of second vent holes 110 to evacuate gas therethrough. Although also not shown, it is further contemplated that notches may be disposed through either or both of the first and second product side profiles 78, 84, instead of or in addition to the plurality of first vent holes 104, to facilitate evacuation of gas from the interior 62 when using the vacuum device.

Figure 6:
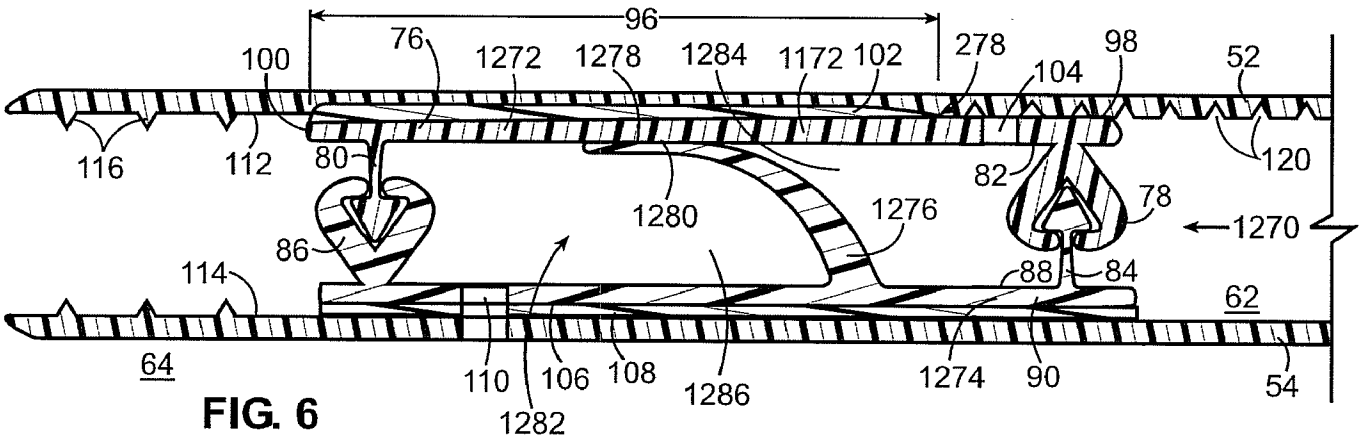
FIG. 6 is a cross sectional view of a further embodiment of a closure mechanism, taken generally along the lines 2-2 of FIG. 1 with portions behind the plane of the cross section omitted for clarity.

Another embodiment of a resealable closure mechanism 1270 is similar to the embodiment described with regard to FIG. 5 except for the following differences, as illustrated in FIG. 6. In this embodiment, a first closure element 1272 entirely lacks a sealing flap. A second closure element 1274 includes a single sealing flap 1276 that extends from the second base 90. The first base 76 includes a first contact surface 1278 and the single sealing flap 1276 includes a second contact surface 1280. Upon occlusion of the first and second closure elements 1272, 1274, the single sealing flap 1276 is forced against the first base 76 in a sealed state 1282, in which the first and second contact surfaces 1278, 1280 engage one another to form a gastight seal therebetween.

A first space 1284 is defined within the closure mechanism 1270 between the single sealing flap 1276 and the first and second product-side closure profiles 78, 84. Similarly, a second space 1286 is defined between the single sealing flap 1276 and the first and second user-side closure profiles 80, 86. A pressure imbalance across the single sealing flap 1276 from the first space 1284 to the second space 1286 may force the first and second contact surfaces 1278, 1280 to disengage and break the gastight seal therebetween. Such a pressure imbalance may be created by application of an inward force to the first and second sidewalls 52, 54, or by application of an evacuation device over the plurality of second vent holes 110.

Figure 7:
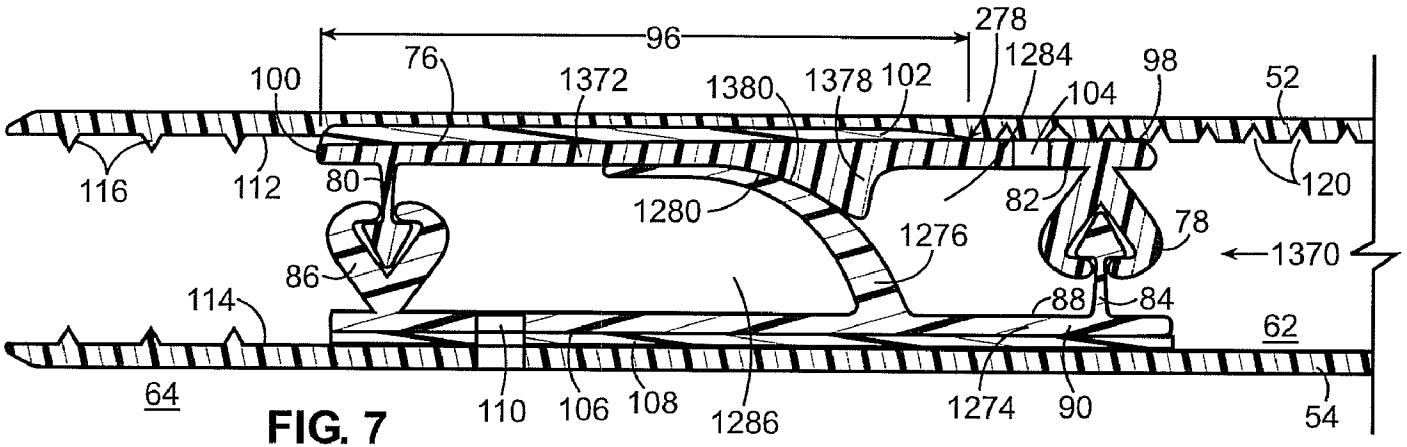
FIG. 7 is a cross sectional view of another embodiment of a closure mechanism, taken generally along the lines 2-2 of FIG. 1 with portions behind the plane of the cross section omitted for clarity.

FIG. 7 illustrates a further embodiment of a resealable closure mechanism 1370 that is substantially similar to the embodiment described with regard to FIG. 6, except for the following differences. A first closure element 1372 includes a sealing bump 1378 that has a smoothly sloping contact surface 1380 that engages and seals against the second contact surface 1280 of the single sealing flap 1276.

Figure 8:
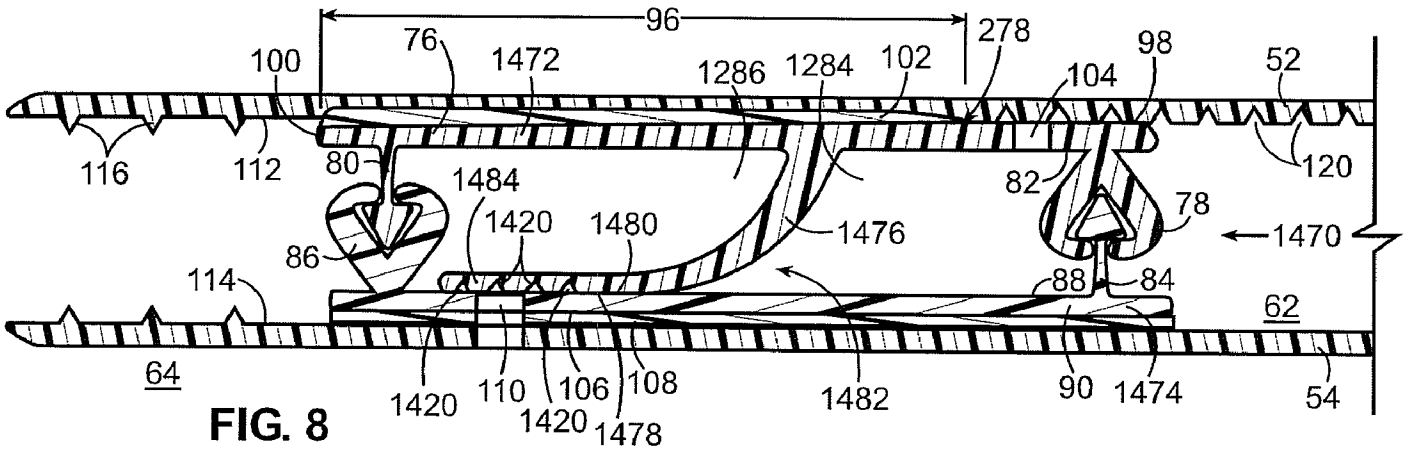
FIG. 8 is a cross sectional view of a still further embodiment of a closure mechanism, taken generally along the lines 2-2 of FIG. 1 with portions behind the plane of the cross section omitted for clarity.

Yet another embodiment of a resealable closure mechanism 1470 is similar to the embodiment described with regard to FIG. 6, except for the following differences, as illustrated in FIG. 8. A first closure element 1472 includes a single sealing flap 1476 that extends from the first base 76. A second closure element 1474 entirely lacks a sealing flap. The second base 90 includes a first contact surface 1478 and the single sealing flap 1476 includes a second contact surface 1480. Upon occlusion of the first and second closure elements 1472, 1474, the single sealing flap 1476 is forced against the second base 90 in a sealed state 1482, in which the first and second contact surfaces 1478, 1480 engage one another to form a gastight seal therebetween. In addition, the single sealing flap 1476 has an end portion 1484 that extends sufficiently to cover the plurality of second vent holes 110 when the first and second closure elements 1472, 1474 are occluded. The end portion 1484 optionally includes a textured pattern 1420 on a side that faces the plurality of second vent holes 110. The textured pattern 1420 on the end portion 1484 may allow the end portion 1484 to prevent foreign matter, for example, particulate or insects, from entering into the second space 1286, while providing flow channels that allow fluid communication between the pouch exterior 64 and the second space 1286 to facilitate application of an evacuation device over the plurality of second vent holes 110. The end portion 1484 may alternatively have a smooth surface that does not include the textured pattern 1420.

Figure 9:
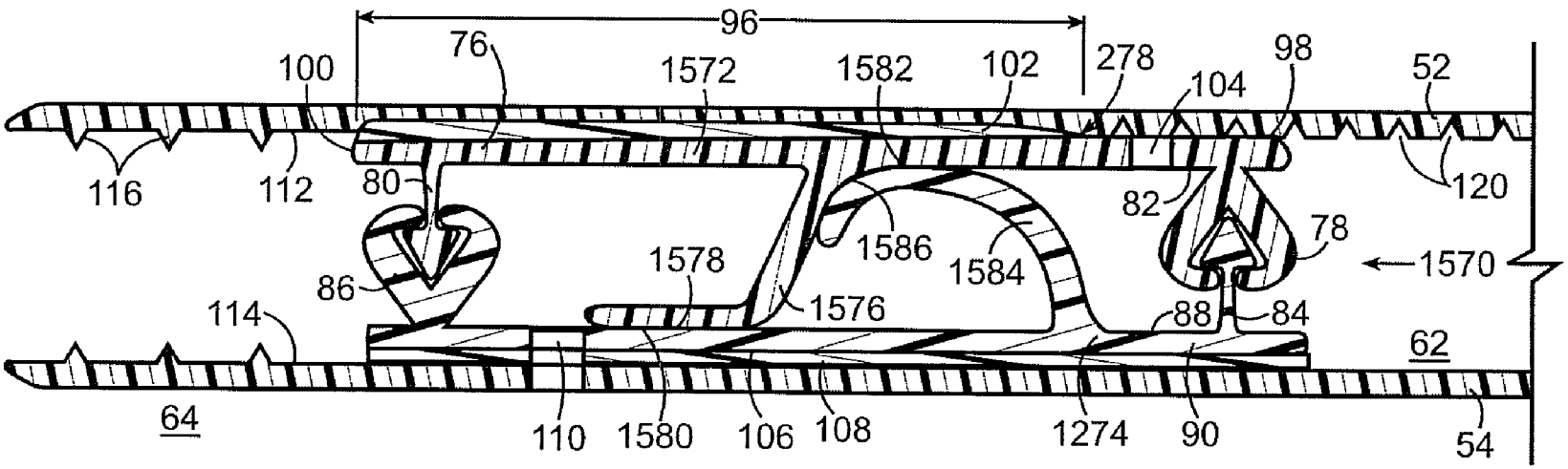
FIG. 9 is a cross sectional view of yet another embodiment of a closure mechanism, taken generally along the lines 2-2 of FIG. 1 with portions behind the plane of the cross section omitted for clarity.

A further embodiment of a resealable closure mechanism 1570 that is similar to the embodiment described with regard to FIG. 6 is illustrated in FIG. 9. In this embodiment, a first closure element 1572 includes a first sealing flap 1576 that extends from the first base 76. The first sealing flap 1576 includes a first contact surface 1578 that engages a second contact surface 1580 on the second base 90 to form a gastight seal therebetween when the first and second closure elements 1572, 1274 are occluded. In addition, a third contact surface 1582 is disposed from a product-side of the first sealing flap 1576 to the interior surface 82 of the first base 76. A second sealing flap 1584 extends from the second base 90 and includes a fourth contact surface 1586. Upon occlusion of the first and second closure elements 1572, 1274, the first sealing flap 1576 is forced against the second base 90 to form a first gastight seal between the first and second contact surfaces 1578, 1580, and the fourth contact surface 1586 of the second sealing flap 1584 is forced against the third contact surface 1582 to form a second gastight seal therebetween.

In the manufacture of a pouch described herein, for example, in the embodiment of the pouch 50 shown in FIG. 1, the first and second sidewalls 52, 54 may be extruded as a single flat sheet that is folded over onto itself to form the bottom peripheral edge 58 for the pouch 50. The first and second closure elements, for example, 72 and 74 may each extruded as a tape, independently from the first and second sidewalls 52, 54. The first and second bases 76, 90 may be sealed to the interior surfaces 112, 114 of the respective first and second sidewalls 52, 54 by a heat seal or application of a thermoplastic weld layer, or by some other method as may be known to a person of skill in the art. The resealable pouch 50 described herein can be made by various techniques known to those skilled in the art including those described in, for example, Geiger et al., U.S. Patent No. 4,755,248. Other useful techniques to make a resealable pouch include those described in, for example, Zieke et al., U.S. Pat. No. 4,741,789. Additional techniques to make a resealable pouch include those described in, for example, Porchia et al., U.S. Pat. No. 5,012,561. Additional examples of making a resealable pouch as described herein include, for example, a cast post applied process, a cast integral process, and/or a blown process.

Referring to FIGS. 2-9, the inner surfaces 112, 114 of the respective first and second sidewalls 52, 54 or a portion or area thereof may be composed of a tacky material that may assist in maintenance of contact with an opposing surface. For example, the inner surfaces 112, 114 of the respective first and second sidewalls 52, 54 may be composed of a polyolefin plastomer such as an AFFINITY™ resin manufactured by Dow Plastics. Further, portions of any of the first and/or second closure elements, or any of the contact surfaces described in the embodiments hereinabove may, for example, be composed of a polyolefin plastomer. Illustratively, one or more of the first, second, third, and fourth contact surfaces 178, 180, 480, 482 that are illustrated in FIGS. 2A-2E may, for example, be composed of a polyolefin plastomer. Similarly, the exterior surface 98 of the first base 76 and/or the exterior surface 106 of the second base 90 may, for example, be composed of a polyolefin plastomer.

Various details shown in FIGS. 1-9 may be modified as will be apparent to those of skill in the art without departing from the disclosed principles. Other methods and materials suitable for forming structures of the present invention may also be utilized. For example, one or more sets of any embodiment of corresponding sealing flaps and/or contact surfaces may be used in combination with any of the embodiments of closure elements described hereinabove.

INDUSTRIAL APPLICABILITY

A resealable closure mechanism that may be used on reclosable flexible pouches has been presented. A simple venting mechanism is disposed within the closure mechanism to allow a user to occlude the closure mechanism and subsequently force excess gas out of the pouch.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive right to all modifications within the scope of the impending claims is expressly reserved. All patents, patent publications and applications, and other references cited herein are incorporated by reference herein in their entirety.

We claim:

1. A pouch including a closure mechanism, comprising:

a first sidewall and a second sidewall, the first and second sidewalls defining an interior of the pouch for containing a product and a mouth for access into the interior;

the closure mechanism extending from one end of the mouth to a second end of the mouth to resealably seal the mouth, the closure mechanism comprising;

a first closure profile that extends from an interior surface of a first base of a first closure element and a second closure profile that extends from an interior surface of a second base of a second closure element, wherein the first and second closure profiles interlock to form a seal extending the length of the mouth;

a third closure profile that extends from the interior surface of the first base on a user-side of the first closure profile opposite the interior and a fourth closure profile that extends from the interior surface of the second base on the user-side of the second closure profile, wherein the third and fourth closure profiles interlock to form a seal extending the length of the mouth;

a sealing flap that extends from the interior surface of the first base and is disposed between the first and third closure profiles, wherein the sealing flap engages the interior surface of the second base to form a releasable gastight seal extending the length of the mouth and to allow gas flow only from the interior toward the exterior; and a first exhaust channel through at least one of the first base and the second base and disposed between the sealing flap and the first and second closure profiles when the first and second closure elements are occluded, and a second exhaust channel through the closure mechanism disposed on a user-side of the sealing flap when the first and second closure elements are occluded;

wherein the first sidewall is attached to the first base at a first sidewall sealing region disposed on an exterior surface of the first base between a user-side edge of the first base and the sealing flap, wherein an interior surface of the pouch sidewall facing the first exhaust channel is textured with a flow channel between the interior and the first exhaust channel; and the second sidewall is attached to the second base at an exterior surface of the second base;

whereby increased gas pressure in the interior of the pouch when the closure mechanism is occluded causes gas to exhaust from the interior of the pouch through the flow channel, the first exhaust channel, past the sealing flap, and through the second exhaust channel, and whereby the sealing flap prevents gasses from reentering the interior from the exterior when the closure mechanism is occluded.

2. The pouch of claim 1, wherein the second base includes a sealing surface that extends from the interior surface of the second base between the second and fourth closure profiles and includes a smooth contact surface that engages and seals against the sealing flap.

3. The pouch of claim 1, wherein the second exhaust channel extends through the second base between the second and fourth closure profile.

4. The pouch of claim 3, wherein the second exhaust channel is disposed coincidentally through the second base and the second pouch sidewall.

5. The pouch of claim 4, wherein an end portion of the sealing flap covers the second exhaust channel when the first and second closure elements are occluded.

6. The pouch of claim 5, wherein a first plurality of longitudinally spaced first exhaust channels is disposed through the first base between the sealing flap and the first closure profile, and wherein the first base is not attached to the first sidewall from a product side edge of the first base to the first plurality of longitudinally spaced first exhaust channels and from the first end of the closure mechanism to the second end of the closure mechanism.

7. The pouch of claim 6, wherein the interior surface of the first pouch sidewall is textured with a pattern that forms flow channels along the interior surface of the first pouch sidewall between the product-side edge of the first base and the first plurality of longitudinally spaced first exhaust channels.

8. The pouch of claim 3, wherein the second base is attached to the second pouch sidewall at a second sidewall sealing region disposed on an exterior surface of the second base and only between a product-side edge of the second base and the sealing flap when the first and second closure elements are occluded.

9. The pouch of claim 1 further including a second sealing flap that extends from the interior surface of the second base between the second and fourth closure profiles, wherein the second sealing flap engages the interior surface of the first base to form a releasable gastight seal therebetween when the first and second closure elements are occluded.

10. The pouch of claim 1, wherein the second exhaust channel is disposed through the fourth closure profile.

11. A pouch with a venting closure mechanism, comprising:

a first closure profile that extends from an interior surface of a first base of a first closure element and a second closure profile that extends from an interior surface of a second base of a second closure element, wherein the first and second closure profiles interlock to form a seal therebetween;

a third closure profile that extends from the interior surface of the first base on a user-side of the first closure profile and a fourth closure profile that extends from the interior surface of the second base on a user-side of the second closure profile, wherein the third and fourth closure profiles interlock to form a seal therebetween;

a first sealing flap that extends from the interior surface of the first base between the first and third closure profiles and toward the first closure profile in a relaxed state and a second sealing flap that extends from the interior surface of the second base between the second and fourth closure profiles and toward the fourth closure profile in a relaxed state, wherein the first sealing flap engages the second sealing flap to form a releasable gastight seal therebetween;

a first plurality of longitudinally spaced first exhaust channels disposed on a product-side of the first and second sealing flaps when the first and second closure elements are occluded and a second plurality of longitudinally spaced second exhaust channels disposed on a user-side of the first and second sealing flaps when the first and second closure elements are occluded;

a first pouch sidewall attached to the first base at a first sidewall sealing region disposed on an exterior surface of the first base between a user-side edge of the first base and the first sealing flap; and a second pouch sidewall attached to the second base at an exterior surface of the second base.

12. The pouch of claim 11, wherein the first plurality of longitudinally spaced first exhaust channels is disposed through the first base between the first sealing flap and the first closure profile.

13. The pouch of claim 11, wherein the second plurality of longitudinally spaced second exhaust channels is disposed coincidentally through the first base and the first pouch sidewall between the first sealing flap and the second closure profile.

14. The pouch of claim 11, wherein the second plurality of longitudinally spaced second exhaust channels is disposed through the second base between the second and fourth closure profiles.

15. The pouch of claim 14, wherein the second base is attached to the second pouch sidewall at a second sidewall sealing region disposed on an exterior surface of the second base between a product-side edge of the second base and the second sealing flap.

16. The pouch of claim 11, wherein the second plurality of longitudinally spaced second exhaust channels is disposed through the third closure profile.

17. The pouch of claim 11, wherein the second plurality of longitudinally spaced first exhaust channels is disposed through the first closure profile, and wherein an interior surface of the first pouch sidewall is textured with a pattern that provides flow channels along the interior surface of the first pouch sidewall.

18. The pouch of claim 11, wherein the first and second sealing flaps are each substantially linear in cross section, and wherein a contact area where the first sealing flap contacts the second sealing flap comprises a tacky surface.

19. A pouch with a venting closure mechanism, comprising:

a first closure profile that extends from an interior surface of a first base of a first closure element and a second closure profile that extends from an interior surface of a second base of a second closure element, wherein the first and second closure profiles interlock to form a gastight seal therebetween;

a third closure profile that extends from the interior surface of the first base on a user-side of the first closure profile and a fourth closure profile that extends from the interior surface of the second base on a user-side of the second closure profile, wherein the third and fourth closure profiles interlock to form a gastight seal therebetween;

a first sealing flap that extends from the interior surface of the first base between the first and third closure profiles and toward the third closure profile in a relaxed state and a second sealing flap that extends from the interior surface of the second base between the second and fourth closure profiles and toward the fourth closure profile in a relaxed state, wherein the first sealing flap engages the second sealing flap to form a releasable gastight seal therebetween;

a first plurality of longitudinally spaced first exhaust channels disposed on a product-side of the first and second sealing flaps when the first and second closure elements are occluded and a second plurality of longitudinally spaced second exhaust channels disposed on a user-side of the first and second sealing flaps when the first and second closure elements are occluded;

a first pouch sidewall attached to the first base at a first sidewall sealing region disposed on an exterior surface of the first base between a user-side edge of the first base and the first sealing flap; and a second pouch sidewall attached to the second base at an exterior surface of the second base.

20. The pouch of claim 19, wherein the first plurality of longitudinally spaced first exhaust channels is disposed through the first base, and wherein an interior surface of the first pouch sidewall is textured with a pattern that provides flow channels along the interior surface of the first pouch sidewall.

* * * * *